US008541701B2

(12) United States Patent
Asada

(10) Patent No.: US 8,541,701 B2
(45) Date of Patent: Sep. 24, 2013

(54) SWITCH

(75) Inventor: Makoto Asada, Yao (JP)

(73) Assignee: Hosiden Corporation, Osaka (JP)

( * ) Notice: Subject to any disclaimer, the term of this patent is extended or adjusted under 35 U.S.C. 154(b) by 2 days.

(21) Appl. No.: 13/563,183

(22) Filed: Jul. 31, 2012

(65) Prior Publication Data

US 2012/0292166 A1 Nov. 22, 2012

Related U.S. Application Data

(63) Continuation of application No. 12/279,260, filed as application No. PCT/JP2007/052086 on Feb. 7, 2007, now Pat. No. 8,283,583.

(30) Foreign Application Priority Data

Feb. 21, 2006 (JP) ..... 2006-043943
Feb. 21, 2006 (JP) ..... 2006-043944
Feb. 21, 2006 (JP) ..... 2006-043945
Feb. 21, 2006 (JP) ..... 2006-043946

(51) Int. Cl.
*H01H 19/00* (2006.01)
*H01H 21/00* (2006.01)

(52) U.S. Cl.
USPC ..... 200/6 A; 200/4

(58) Field of Classification Search
USPC ..... 200/6 A, 4, 6 R
See application file for complete search history.

(56) References Cited

U.S. PATENT DOCUMENTS

| | | | | |
|---|---|---|---|---|
| 4,874,911 | A | 10/1989 | Parrish | |
| 6,124,555 | A | 9/2000 | Isikawa | |
| 6,621,016 | B2 * | 9/2003 | Ohba et al. | 200/4 |
| 6,720,504 | B2 * | 4/2004 | Nishimoto et al. | 200/4 |
| 2004/0003985 | A1 | 1/2004 | Nishimoto et al. | |

FOREIGN PATENT DOCUMENTS

| | | |
|---|---|---|
| JP | 11312442 | 11/1999 |
| JP | 2000123690 | 4/2000 |
| JP | 2001229786 | 8/2001 |
| JP | 2002280756 | 9/2002 |
| JP | 2003263940 | 9/2003 |
| JP | 2005302642 | 10/2005 |

* cited by examiner

*Primary Examiner* — R S Luebke
*Assistant Examiner* — Lheiren Mae Caroc
(74) *Attorney, Agent, or Firm* — The Webb Law Firm

(57) ABSTRACT

A switch for detecting a tilting operation is constructed easy to assemble. A tilt detecting section A is provided on an upper surface of an intermediate wall portion 12B of an upper case 12, a depression detecting section B is provided in a central position of an upper surface of a bottom wall portion 13B of a lower case 13, and a rotation detecting section C is provided around the depression detecting section. A top cover 11 is provided to cover an upper end of the upper case 12 to which the upper case 12 is engageably connected. The lower case 13 is engageably connected to the upper case 12.

5 Claims, 9 Drawing Sheets

SWITCH

CROSS-REFERENCE TO RELATED APPLICATIONS

This application is a continuation of U.S. application Ser. No. 12/279,260, filed on Aug. 13, 2008, which is the United States National Stage of International Application No. PCT/JP2007/052086, filed on Feb. 7, 2007 and published as International Application Publication No. WO 2007/097194, both of which are hereby incorporated by reference in their entireties.

TECHNICAL FIELD

The present invention relates to a switch comprising a tilting operation detecting section for electrically detecting a tilting operation of a control rod supported by a casing.

BACKGROUND ART

Patent Document 1 identified below shows an example of the switch having the construction noted above. According to Patent Document 1, the switch comprises a control rod (described as a control axis in the document) provided in a casing including a first case, a second case and a third case combined together, and a drive member fitted on the control rod at a lower edge thereof to be rotatable in unison with the control rod and slidable axially of the control rod. The drive member includes a disk-shaped oscillating contact plate made of a conductor and rotatable in unison therewith, and a rotary member rotatable in unison with the drive member.

The first case provided in an upper portion of the casing has fixed contacts arranged adjacent a lower side of a base member thereof in positions surrounding the control rod crosswise. The oscillating contact plate is in contact with a compression spring formed of a conductor such as a metal wire material or the like. The compression spring has a lower end in contact with a common fixed contact (described later). As the control rod is tilted (oscillated), the fixed contact is brought into contact with the oscillating contact plate to establish a conductive state thereby to electrically detect the tilting direction (corresponding to the tilt detecting section of the present invention).

The second case provided in an intermediate portion of the casing has a code pattern formed of a conductor such as a metal and provided on an inner surface thereof. A sliding element is provided on a lower surface of the rotary member for contacting the code pattern. As the control rod is rotated, an angle of rotation is detected from a contact between the code pattern and the sliding element as an encoded electrical signal (corresponding to the rotation detecting section of the present invention).

The third case provided in a bottom portion of the casing has a central fixed contact arranged in the center of an inner surface of a bottom wall portion thereof. The common fixed contact is arranged outwardly of the central fixed contact, while a movable contact having a dome-shaped bulging portion contacting the common fixed contact at peripheries thereof and spaced from the central fixed contact. Further, a depressing member is arranged above the bulging portion of the fixed contact so that an upper end thereof may contact the lower end of the control rod. When the control rod is depressed, the bulging portion of the movable contact is elastically deformed to the extent of contacting the central contact by an operational force from the control rod to establish a conductive state between the common fixed contact and central fixed contact, thereby electrically detecting the depressing operation (corresponding to the depression detecting section of the present invention). Patent Document 1: Japanese Unexamined Application Publication No. 2005-302642

DISCLOSURE OF THE INVENTION

Problem to be Solved by the Invention

Since the switch having the above-noted construction is often provided in relatively small devices such as mobile phones, PDAs, game equipment controllers, remote controllers and the like, its downsizing is generally desired. Also, taking miniaturization into consideration, it is necessary to arrange the tilt detecting section for detecting a tilting operation of the control rod, the depression detecting section for detecting a depressing operation and the rotation detecting section, in a way to facilitate their assembling in the casing.

For the forgoing reason, the combined control switch in Patent Document 1 secures facility of assembly by combining the three members (the first case, second case and third case) into the casing. More particularly, in order to arrange the tilt detecting section, depression detecting section and rotation detecting section in a single space formed within the casing, the contacts constituting these detecting sections are arranged to be exposed to the inner space while the members contacting the contacts are arranged in positions facing the contacts.

However, according to the combined control switch of Patent Document 1, in assembling the unit, the contacts are arranged in positions exposed to the inner space, and the oscillating contact plate, rotary member and the like are arranged in the inner space in positions corresponding to the contacts. Then, the three members constituting the casing are connected and fixed to one another. It is therefore difficult to confirm conductive states of the contacts in part of the detecting sections before connecting and fixing the three members. A poor conductive state is sometimes found after the unit is assembled.

Particularly, the contacts are arranged in positions exposed to the single inner space, which leads to a disadvantage that it is difficult to employ a conductive construction having a complicated structure. To give an example, a construction is conceivable for detecting a tilting operation of the control rod by using a plurality of combinations each having the movable contact and the two types of fixed contacts as in the case of the depression detecting section of Patent Document 1. In this case, however, since the movable contact is simply placed on the two types of fixed contacts, it is necessary to consider, in assembling the unit, the direction in which the force of gravity is applied, which leaves room for improvement.

An object of the invention is to provide a switch with a rational construction to be easily assembled.

Further, in the case of a switch for detecting operations in multiple directions, it is required to properly detect an operation in each direction without false detection.

Considering the mode of operation in Patent Document 1, when the control rod is depressed, the control rod independently moves in an axial direction to elastically deform the movable contact provided in the bottom portion of the casing, thereby establishing an electrically conductive state. On the other hand, when the control rod is rotated, the rotary member is rotated, thereby detecting an angle of rotation based on a contact between the code pattern and the sliding element. However, since the oscillating contact plate also rotates in unison with the control rod, the oscillating contact plate not simply contacts the fixed contact but slidably contacts the fixed contact when the control rod is rotated while being tilted, for example. This sometimes makes the fixed contact undergo abrasion, and the friction caused by the sliding contact may act as an operational resistance.

Thus, the conventional construction involves operation of portions which are not primarily required to be operated when a specific operation is executed. This sometimes produces operational resistance and undermines durability as noted above, which possibly leads to false detection. Therefore, there is room for improvement.

Accordingly, another object of the present invention is to provide a switch with a rational construction for realizing proper detection without involving any unwanted operations.

Further, according to the switch in which the depression detecting section is formed to have the fixed contact combined with the movable contact provided in the bottom wall portion of the casing as in Patent Document 1, proper detection is made possible by a depressing force applied to the depression detecting section from a direction perpendicular to the bottom wall portion.

However, in the construction of the switch disclosed in Patent Document 1, when the operator executes a depressing operation with the control rod being tilted, the depressing force is applied to a position deviated from the central position of the movable contact of the depression detecting section, or the depressing force is applied to the movable contact from an oblique direction (a direction inclined with respect to the plane of the bottom wall portion). This may lead to a failure in establishing a conductive state due to insufficient deformation of the movable contact, which leaves room for improvement.

Thus, a further object of the present invention is to provide a switch with a rational construction capable of properly detecting a depressing operation even when the depressing operation is executed with the control rod being tilted.

Further, according to the switch in which the oscillating contact plate contacts the fixed contact to establish a conductive state when the control rod is tilted as in Patent Document 1, the control rod reaches a tilting limit by contact between the oscillating contact plate and the fixed contact. Thus, the operator of the switch grasps that the control rod is operated to the tilting limit by the feel.

However, the switch of this type includes a spring urging the control rod to a neutral position as disclosed in Patent Document 1. When the control rod is tilted to be operated, the larger the amount of operation becomes, the greater urging force is applied from the spring. Thus, it is sometimes difficult to grasp the fact that the control rod is operated to the tilting limit as the feel of the fingers operating the rod.

In order to overcome such a disadvantage, it is conceivable to employ a construction similar to that of Patent Document 1 in which the movable contact and the central fixed contact are provided for grasping a tilting operation of the control rod based on a feel of clicking. However, the movable contact is made of a relatively thin metal plate or the like, and thus sometimes is damaged when a strong pressure is applied, which leaves room for improvement.

In particular, in the case of a switch as provided in TV game controllers that is used in an environment where operation takes place frequently and strong force tends to be applied, a device allowing the operator to properly grasp a tilting operation and having high durability is desirable.

A still further object of the present invention is to provide a switch with a rational construction for allowing the operator to grasp a tilting operation by the feel and having high durability.

Means for Solving the Problem

The characteristic feature of the present invention lies in a switch comprising a tilt detecting section for electrically detecting a tilting operation of a control rod supported by a casing, the switch further comprising a depression detecting section for electrically detecting a depressing operation of the control rod in a direction along a rod axis of the control rod, and a rotation detecting section for electrically detecting a rotational operation of the control rod, wherein the casing has a structure including, layered and connected to each other, an upper case provided to an upper side and a lower case provided to a bottom side, wherein the upper case includes an intermediate wall portion perpendicular to the rod axis of the control rod resting in a neutral position, the tilt detecting section being provided adjacent an upper surface of the intermediate wall portion, in a position surrounding the control rod, and wherein the lower case includes a bottom wall portion parallel to the intermediate wall portion, the depression detecting section being provided in a central position of an upper surface side of the bottom wall portion, the tilt detecting section being provided in a position surrounding the depression detecting section, and above the rotation detecting section along the rod axis in the neutral position.

With this construction, since the tilt detecting section is provided adjacent the upper surface of the intermediate wall portion while the depression detecting section and the rotation detecting section are provided on the bottom wall portion of the lower case, it is possible to confirm a conductive state of the tilt detecting section before connecting the upper case to the lower case, and similarly possible to confirm conductive states of the depression detecting section and the rotation detecting section. Further, since the tilt detecting section and the rotation detecting section are arranged in positions overlapping each other as viewed from a direction along the rod axis, each of the detecting sections is provided adjacent outer peripheries of the casing to allow numerous contacts to be arranged, which can enhance resolution. As a result, the combined switch easy to assemble is rationally provided even if it has a large number of parts. In particular, even if the construction includes the tilt detecting section having numerous parts combined together, the switch can be assembled without running counter to the gravity-acting since the tilt detecting section is arranged adjacent the upper surface of the intermediate wall portion.

According to the present invention, the tilt detecting section may include, arranged in positions surrounding the control rod, a spring plate element made of a conductor elastically deformable by action of a depressing force and a pair of electrodes for contacting the spring plate element as elastically deformed, thereby establishing a conductive state. The pair of electrodes may be electrically connected to a circuit formed in the intermediate wall portion.

With this construction, when the control rod is tilted, the spring plate element associated with the tilting operation is elastically deformed to contact the pair of electrodes. Since the operational force acting on the spring plate element is reflected on the control rod when the tilting operation is executed, it is possible to grasp the tilting operation as a feel of clicking, for example. Further, since the spring plate element is elastically deformed thereby making the pair of electrodes conductive with each other, the conductive state can be fetched through the circuit formed in the intermediate wall portion.

According to the present invention, the depression detecting section may include a spring plate element made of a conductor elastically deformable by action of a depressing force and a pair of electrodes for contacting the spring plate element as elastically deformed, thereby establishing a conductive state. The pair of electrodes may be electrically connected to a circuit formed in the bottom wall portion.

With this construction, when the control rod is depressed, the spring plate element is elastically deformed to contact the pair of electrodes thereby establishing a conductive state. The conductive state can be fetched through the circuit formed in the bottom wall portion.

In the above-noted construction, the upper case may have a structure including a side wall portion surrounding outer peripheries of the intermediate wall portion, the side wall portion having an upper end rigidly connected to a top cover.

With this construction, it is possible to use a construction having the upper case opened upward, which makes an assembling process easier.

In the above-noted construction, the side wall portion may include a plurality of engaging portions formed to project from or to be recessed in an outer surface thereof while the top cover and the lower case include connecting pieces projecting therefrom and having connecting portions, respectively, to be engageable with and connected to the engaging portions. The top cover may be placed over the upper case to engage and connect the engaging portions of the upper case with/to the connecting pieces of the top cover, while the lower case may be placed under the upper case to engage and connect the engaging portions of the upper case with/to the connecting portions of the lower case.

With this construction, the connecting portions of the top cover are connected to the engaging portions of the side wall portion while the connecting portions of the lower case are connected to the engaging portions of the side wall portion, thereby holding the upper case to be connected and fixed in between. This realizes a connection with the relative positional relationship between the top cover, upper case and lower case being maintained rigidly.

Another characteristic feature of the present invention lies in a switch comprising a tilt detecting section for electrically detecting a tilting operation of a control rod supported by a casing, the switch further comprising:

a depression detecting section for electrically detecting a depressing operation of the control rod in a direction along a rod axis of the control rod, and a rotation detecting section for electrically detecting a rotational operation of the control rod, and an operative member fitted on and supported by the control rod to be rotatable about the rod axis relative to the control rod and relatively movable along the rod axis, and to be tilted together with the control rod tilted, the tilt detecting section executing a detecting operation with tilting movement of the operative member, wherein the depression detecting section is provided in a bottom wall portion of the casing adjacent an inner surface thereof to execute a detecting operation by pressure received from the control rod when the control rod is depressed, and wherein the switch further comprises a rotor rotatable in unison with the control rod rotated and maintaining a predetermined position relative to the casing when the control rod is depressed or tilted, the rotation detecting section detecting a rotational operation of the rotor.

With this construction, when the control rod is tilted, the operative member is tilted together with the control rod without transmitting the tilting movement to the rotor and the depression detecting section, whereby the tilt detecting section detects the tilting operation. When the control rod is depressed, the depression detecting section detects the depressing operation from the control rod without transmitting the depressing force to the operative member and the rotor. When the control rod is rotated, the rotational force is transmitted to the rotor to be rotated, without being transmitted to the operative member and the depression detecting section, whereby the rotation detecting section detects the rotation operation of the rotor. As a result, it is possible to provide the switch having a rational construction for properly detecting plural types of operation, eliminating false detections and decrease of durability, without involving any unwanted operations.

In the above-noted construction, the casing may have a top cover including a concave guide surface formed on an inner surface thereof to be equidistant from a tilt center of the control rod, and wherein an urging force produced by a return spring for urging the control rod in a direction counter to the depressing operation is exerted from the control rod on the operative member, thereby placing the operative member in pressure contact with the guide surface.

With this construction, the operative member is maintained in contact with the guide surface formed on the inner surface of the top cover by the urging force produced by the return spring. As the control rod is tilted, the operative member fitted on the control rod is moved along the guide surface, thereby allowing the control rod to be tilted about the tilting center.

According to the present invention, a bore portion may be formed in the operative member into which the control rod is inserted to be rotatable and relatively movable in the direction of the rod axis, and a plurality grooves may be formed in inner peripheries of the bore portion to be parallel to the rod axis.

With this construction, the grooves are formed in the inner peripheries of the bore portion of the operative member, thereby preventing the inner peripheries of the bore portion from closely contacting the outer peripheries of the control rod to realize smooth and light relative movement and relative rotation.

According to the present invention, the depression detecting section may be arranged on the inner surface of the bottom wall portion of the casing, in a position below the control rod in the neutral position, and a return spring of the compression coil type may be arranged in a position surrounding the depression detecting section.

With this construction, it is possible to allow the return spring to apply an equal urging force to the control rod from the position surrounding the depression detecting section. Thus, when the control rod is depressed, the control rod is not disadvantageously tilted with reference to the depression detecting section.

According to the present invention, the top cover of the casing may include a through bore for receiving the control rod, the through bore having an inner peripheral surface formed as an inclined surface extending toward the tilt center.

With this construction, when the control rod is tilted, the control rod contacts the inclined surface through a large surface extending longitudinally of the control rod, which prevents wear of the inner peripheral surface. In the case of the control rod tiltable crosswise, for example, the through bore has a cross shape as viewed from a direction along the rod axis, which can increase strength compared with a circular bore.

According to the present invention, the tilt detecting section may include, arranged in positions surrounding the control rod, a spring plate element made of a conductor elastically deformable by action of a depressing force and a pair of electrodes for contacting the spring plate element as elastically deformed, thereby establishing a conductive state, and depressing portions may be formed on the operative member for applying a depressing force to the plurality of spring plate elements.

With this construction, when the control rod is tilted, a depressing portion exerts a depressing force on the spring plate element to be elastically deformed to make the pair of electrodes conductive, thereby electrically detecting the tilting operation.

According to the present invention, engageable portions may be formed in an inner peripheral surface of a cylindrical portion formed centrally of the rotor while engaging pieces may be formed on the control rod to be engaged with the engageable portions. This allows the control rod to be tilted and depressed while the rotational operation of the control rod may be transmitted to the rotor.

With this construction, the engaging pieces formed on the control rod are fitted into the engageable portions formed in the rotor, thereby allowing the rotational force of the control rod to be transmitted to the rotor while permitting the tilting operation of the control rod.

A still further characteristic feature of the present invention lies in a switch comprising a tilt detecting section for electrically detecting a tilting operation of a control rod supported by a casing, the switch further comprising:

a depression detecting section for electrically detecting a depressing operation of the control rod in a direction along a rod axis of the control rod, wherein the depression detecting section is arranged in a position below the control rod, a return spring is provided for exerting an urging force on the control rod in a direction counter to the depressing operation, and a contact portion is provided on an inner surface of a bottom wall portion of the casing for contacting a lower end of the control rod, thereby exerting a restoring force toward a neutral position, when the control rod is depressed while being tilted.

With this construction, when the control rod is depressed while being tilted, the rod is depressed against the urging force of the return spring. When the depressing operation is executed, the contact portion contacts the lower end of the control rod, whereby a return force is applied from the contact portion to urge the control rod to the neutral position. As a result, the depressing force is exerted on the depression detecting section while the control rod is returned to the neutral position. Thus, when the control rod is depressed as tilted, the contact portion contacts the lower portion of the control rod, thereby allowing the operator to grasp that the control rod is displaced from the proper position by a feel and to recognize that the control rod should be returned to the proper position. As a result, the quite simple construction that the contact portion is formed on the bottom wall portion of the casing can provide a rational arrangement of the switch which not only allows the operator, when the control rod is depressed as tilted, to positively return the control rod to the neutral position to be depressed, but also makes the operator recognize that the control rod should be returned to the proper position.

In the above-noted construction, a spring bearing member may be provided at the lower end of the control rod for receiving the urging force from the return spring, wherein a positional relative relationship is determined so that the spring bearing member contacts the contact portion when the control rod is tilted.

With this construction, when the control rod is depressed as tilted, the spring bearing member contacts the contact portion in the position closest to the bottom wall portion, thereby to allow the control rod to reliably move toward the neutral position and allow the depressing force to act adjacent the center of the spring plate element. Thus, the depressing operation can be properly detected.

According to the present invention, the contact portion may have a rib shape surrounding the depression detecting section, and the return spring of the compressing coil type may be provided in a position surrounding the contact portion.

With this construction providing the contact portion having a rib shape surrounding the depression detecting section, even in the condition in which a great force is exerted on the control rod placed in the depressing direction such as the case where a knob or the like is driven into the distal end of the control rod to be rigidly connected thereto, the contact portion receives the operational force, thereby avoiding a disadvantage that the depression detecting section B is damaged by an excessive operational force.

According to the present invention, the rotation detecting section for detecting a rotational operation of the control rod may be provided on the bottom wall portion of the casing. The rotation detecting section may include a rotor rotatable by a rotational force of the control rod and an electrode for contacting a contact formed in the rotor. An annular spring bearing member for supporting the return spring may be arranged in a position surrounding the contact portion. The rotor may be provided to rotatably contact outer peripheries of the spring bearing member.

With this construction, when the control rod is rotated, it is possible to rotate the control rod stably with the rotor contacting the outer peripheries of the spring bearing portion. This rotation causes the contact formed in the rotor to contact the electrode, whereby the rotation detecting section detects the rotation.

According to the present invention, the tilt detecting section may include, arranged in positions surrounding the control rod, a spring plate element made of a conductor elastically deformable by action of a depressing force and a pair of electrodes for contacting the spring plate element as elastically deformed, thereby establishing a conductive state, and an operative member may be provided to be relatively rotatable about the control rod and relatively movable along the rod axis of the control rod for exerting a depressing force on a plurality of spring plate elements.

With this construction, when the control rod is tilted, the operative member is tilted with the tilting movement of the control rod to elastically deform one of the spring plate elements of the tilt detecting section corresponding to the tilting direction to establish a detecting state. Thus, smooth operations can be executed without exerting a depressing force on the operative member when the control rod is depressed and without exerting a rotational force on the operative member when the control rod is rotated.

A still further characteristic feature of the present invention lies in a switch comprising a tilt detecting section for electrically detecting a tilting operation of a control rod supported by a casing, wherein the tilt detecting section includes, arranged in positions surrounding the control rod, a spring plate element made of a conductor elastically deformable by action of a depressing force and a pair of electrodes for contacting the spring plate element as elastically deformed, thereby establishing a conductive state, and wherein the switch further comprises an operative member tiltable with tilting movement of the control rod to exert a depressing force on the spring plate element, the operative member having depressing portions formed in positions spaced from the control rod, and shock absorbing elements held between the depression portions and the spring plate element.

With this construction, when the control rod is tilted, the operative member is tilted and the spring plate element corresponding to the tilting direction is elastically deformed by a pressure exerted from the depressing portion of the operative member to contact the pair of electrodes to establish a conductive state, thereby electrically detecting the tilting operation. Further, since the spring plate element is elastically deformed, a feel of clicking is produced when the element is elastically deformed. The operator can grasp that the tilting operation can be electrically detected by the feel of clicking. Also, the shock absorbing elements are provided between the depressing portions and the spring plate element of the operative member, thereby preventing the pressure produced by the depressing portions from concentrating on the spring plate element to restrain the spring plate element from being damaged. As a result, the switch with a rational construction and having high durability is provided for allowing the operator to grasp a tilting operation by the feel.

In the above-noted construction, the shock absorbing elements may be formed integrally with a ring member to project therefrom, the ring member being made of an annular flexible and deformable material and arranged between the plurality of spring plate elements and the operative member.

With this construction, even in the case of the switch having a plurality of spring plate elements arranged in positions surrounding the control rod, the ring member is provided, with the control rod being positioned as the center of the ring member, whereby the plurality of the shock absorbing elements can be arranged between the spring plate elements and the depressing portions of the operative member.

Further, in the above-noted construction, the ring member may have a sheet-like form, wherein the shock absorbing elements are formed to project from a top side and a bottom side of the ring member, and wherein the switch further comprises a spring ring made of an annular spring plate element and combined with the ring member, the shock absorbing elements being inserted into bore portions formed in the spring ring.

With this construction, even if the unit has a low shape-retaining property such as the ring member formed of sheet-like silicon rubber, the shock absorbing elements integrally formed with the ring member are inserted into the bore portions of the spring ring, thereby maintaining the shape of the ring member and maintaining the shock absorbing elements in proper positions.

According to the present invention, the depression detecting section and the rotation detecting section may be arranged on the bottom wall portion of the casing while the spring plate element and the electrodes of the tilt detecting section may be provided adjacent an upper surface of an intermediate wall portion formed in an intermediate position of the casing with respect to the axis direction of the control rod. The operative member may be provided above the spring plate element and the electrodes while the shock absorbing element may be provided between the operative member and the spring plate element.

With this construction, the tilt detecting section is arranged in a position above the depression detecting section and the rotation detecting section, which allows the operative member and the shock absorbing elements to be arranged in positions not affecting the depression detecting section or the rotation detecting section.

According to the present invention, the switch may include a depression detecting section for electrically detecting a depressing operation of the control rod in a direction along a rod axis of the control rod, and a rotation detecting section for electrically detecting a rotational operation of the control rod. The operative member may be fitted on and supported by the control rod to be rotatable about the rod axis relative to the control rod and movable along the rod axis relative to the control rod to be tilted together with the control rod tilted.

With this construction, the control rod is moved in the direction of the rod axis when depressed, without exerting the depressing force on the operative member, whereby the depression detecting section detects the movement. Similarly, the control rod is rotated without exerting the rotational force on the operative member, whereby the rotation detecting section detects the rotation.

BEST MODE FOR CARRYING OUT THE INVENTION

An embodiment of the present invention will be described hereinafter with reference to the drawings.

[Overall Structure]

A combined switch as shown in FIGS. 1 through 5 comprises a casing 10, a control rod 20 supported by the casing 10 to extend upward, a tilt detecting section A for electrically detecting a tilting operation of the control rod 20, a depression detecting section B for electrically detecting a depressing operation of the control rod 20 executed along a rod axis Y of the control rod 20, and a rotation detecting section C for electrically detecting a rotational operation of the control rod 20.

Such a combined switch is mountable on mobile phones, PDAs, game equipment controllers, remote controllers of household electric appliances, and the like. With this combined switch, the vertical direction is not relevant in use. For the purpose of description, the upside in FIG. 3 will be referred to as the upper side while the downside in FIG. 3 will be referred to as the lower side.

With this combined switch, the control rod 20 maintains a neutral position N when resting in a non-operational state, and the tilt detecting section A detects crosswise tilting operations with reference to the neutral position N.

With the axis of the control rod 20 being defined as the rod axis Y, the depression detecting section B electrically detects a depressing operation executed along the rod axis Y.

Further, the rotation detecting section C electrically detects an amount of rotational operation about the rod axis Y of the control rod 20 resting in the neutral position N.

With this combined switch, when the control rod 20 is operated crosswise along a horizontal plane (namely, four directions in all), the tilt detecting section A detects tilting operations of the control rod 20 in the four directions. Instead, the tilt detecting section may detect tilting operations in less than four directions, or five or more directions such as eight directions.

The casing 10 includes a top cover 11, an upper case 12 and a lower case 13, which are connected to each other. Each of the top cover 11, the upper case 12 and the lower case 13 is formed by molding an insulating resin material in dies. As shown in FIGS. 2 and 4, each of the upper case 12 and the lower case 13 is generally octagonal as viewed from the direction along the rod axis Y in the neutral position N.

The top cover 11 has a through bore 11A formed in a central portion thereof. The control rod 20 vertically extends through the through bore 11A. As shown in FIG. 3, the top cover 11 has a concave guide surface 11G formed in a bottom surface side thereof which is equidistant from a tilt center P of the control rod 20. Further, as shown in FIGS. 1 and 4, the top cover 11 has four connecting pieces 14 integrally formed with outer peripheries thereof to project downward. Each connecting piece 14 is provided at a distal end thereof with a hole-type engageable connecting portion 14A.

As shown in FIG. 2, the through bore 11A of the top cover 11 has a crosswise guide groove 11AG extending along tilting directions as viewed from the top. Also, as shown in FIG. 3, the guide groove 11AG has inner surfaces formed as inclined surfaces tapered toward the tilt center P.

As shown in FIG. 3, the upper case 12 includes a cylindrical side wall portion 12A extending along the rod axis Y in the neutral position N, and an intermediate wall portion 12B perpendicular to the rod axis Y in the neutral position N. These two wall portions are formed integrally with each other. As shown in FIG. 4, the intermediate wall portion 12B has an aperture 12H formed in the central portion thereof. The side wall portion 12A has eight engaging pieces 12T (one example of engaging portions) projecting from outer peripheries thereof and arranged equidistantly in the circumferential direction.

As shown in FIGS. 3 and 11, the intermediate wall portion 12B has four center electrodes 31 arranged on an upper surface thereof at regular intervals on a circumference centering on the control rod 20 to serve as four detecting positions. A generally ring-shaped ring electrode 32 is provided to surround each center electrode 31.

Inside the intermediate wall portion 12B of the upper case 12 are provided independent tilt detecting circuits (not shown) conductive with the four center electrodes 31 individually, and a common circuit (not shown) conductive with the four ring electrodes 32, both of which are formed by insert molding. Further, as shown in FIG. 3, four tilt detecting leads 33 project downward that are conductive with the tilt detecting circuits, while a single common lead 34 projects downward that is conductive with the common circuit.

As shown in FIG. 5, the lower case 13 includes a cylindrical side wall portion 13A extending along the rod axis Y in the neutral position N, and a bottom wall portion 13B perpendicular to the rod axis Y in the neutral position N. These two wall portions are formed integrally with each other. On the central portion of the top surface of the bottom wall portion 13B are formed an annually projecting contact portion 13C for accommodating the depression detecting section B, and an annually projecting spring bearing 13D arranged concentrically with and outwardly of the contact portion.

As shown in FIGS. 1 and 2, the side wall portion 13A of the lower case 13 includes four connecting pieces 15 formed integrally therewith to project upward. Each of the connecting pieces 15 has a hole-type engageable connecting portion 15A at a distal end thereof.

As shown in FIGS. 3 and 8, the bottom wall portion 13B of the lower case 13 includes, in the central position thereof surrounded by the contact portion 13C, a center electrode 41 made of a conductor, and a ring electrode 42 made of a conductor and formed in a position surrounding the center electrode 41. In the bottom wall portion 13B of the lower case 13 are formed a depression detecting circuit (not shown) conductive with the center electrode 41, and a ring circuit (not shown) conductive with the ring electrode 42, both of which are formed by insert molding. The bottom wall portion 13B further includes a depression detecting lead 43 conductive with the depression detecting circuit and projecting downward, and a ring lead 44 conductive with the ring circuit and projecting downward.

As shown in FIGS. 4 and 8, the bottom wall portion 13B of the lower case 3 includes, arranged circumferentially of the spring bearing 13D, a ring-shaped common electrode 51 made of a conductor, and a plurality of count electrodes 52 made of conductors. The count electrodes 52 are surrounded by numerous ridges and grooves 53 for providing a clicking feel.

The common electrode 51 is conductive with a common lead 54 through a circuit formed inside the bottom wall portion 13B of the lower case 13 by insert molding, while the count electrodes 52 are conductive with a count lead 55 through a circuit formed by insert molding. As shown in FIGS. 1 and 3, the common lead 54 and the count lead 55 project downward from the bottom wall portion 13B of the lower case 13. A plurality of lead holders 13H are formed on lower portions of the outer surface of the lower case 13. The four tilt detecting leads 33 and the one common lead 34 are inserted into apertures formed in the lead holders 13H.

[Control Rod]

The control rod 20 is made using a relatively rigid material such as a copper alloy. As shown in FIG. 4, the control rod includes an upper end portion 21 projecting upward from the casing 10 and having a D-cut portion 21A in a position for receiving a knob or the like, and an intermediate portion 22 having a cylindrical shape. A large diameter portion 23 is formed under the intermediate portion 22. Under the large diameter portion 23 are provided a plurality of engaging pieces 24 forming a gear-shaped element for outputting torque. At a bottom end of the control rod is formed a contact portion 25 having a spherical outer surface (see FIG. 3).

As shown in FIG. 3, a spring bearing member 26 made of resin is rigidly fitted on an intermediate position between the contact portion 25 and the gear-shaped engaging pieces 24. The contact portion 25 has a bulging spherical shape centering on the tilt center P.

[Tilt Detecting Section]

As shown in FIGS. 3 and 4, the tilt detecting section A includes dome-shaped spring plate elements 35 made of conductors and provided in the four detecting positions on the intermediate wall portion 12B of the upper case 12, shock absorbing elements 36A in contact with upper surfaces of the four spring plate elements 35, and an operative member 38 for exerting a depressing force on the spring plate elements 35 through the shock absorbing elements 36A when the control rod 20 is tilted. The spring plate elements 35 are arranged to cover the center electrodes 31 and ring electrodes 32. The four shock absorbing elements 36A are formed integrally with a rubber ring 36 (one example of ring members). A spring ring 37 made of a disk-shaped spring material is tightly mounted on an upper surface of the rubber ring 36.

Each of the spring plate elements 35 employs a disk-shaped material made of a conductor such as a copper alloy, iron alloy or the like, and has a dome shape bulging upward at the central portion thereof. When free from a depressing force, each spring plate member 35 is in contact with the ring electrode 32 at the peripheral portion thereof and out of contact with the center electrode 31 at the central portion thereof.

When a depressing force exceeding a predetermined value is exerted on the central portion of one of the spring plate elements 35 from above, the central portion of the spring plate element 35 is elastically deformed to contact the corresponding center electrode 31 thereby allowing the center electrode 31 to be conductive with the corresponding spring electrode 32. The drawings show a construction in which the single spring plate element 35 is provided in each detecting position. Instead, a plurality of spring plate elements 35 may be layered in each detecting position.

The rubber ring 36 is made of a soft insulating material such as silicon rubber or the like. The shock absorbing elements 36A are formed integrally with the rubber ring 36 to project upward and downward from both the top and bottom surfaces of the rubber ring 36 in four positions. The spring ring 37 has bore portions 37A for receiving the shock absorbing elements 36A. As shown in FIG. 4, the rubber ring 36 and the spring ring 37 have receiving bores 36S and 37S, respectively. Fitting pieces 12S projecting from the intermediate wall portion 12B are fitted to the receiving bores 36S and 37 thereby to support the rubber ring 36 and the spring ring 37 in position.

The operative member 38 is formed by molding an insulating resin material. The operative member 38 includes a bore portion 38A formed in the center thereof, a convex slide contact surface 38G formed in a central top surface thereof for slidably contacting the guide surface 11G formed in the bottom side of the top cover 11, and four depressing portions 38B provided at outer peripheries thereof to project downward.

The bore portion 38A has a plurality of grooves T formed in inner peripheries thereof to be parallel to the rod axis Y of the control rod 20. With the control rod 20 being inserted through the bore portion 38A to fit the intermediate portion 22 of the control rod 20 on the control rod 20, only projecting portions formed on the inner peripheries of the bore portion 38A contact the control rod 20. Therefore, an area of contact between the operative member 38 and the control rod 20 is made small, thereby allowing a light relative rotation about the rod axis Y and a light relative sliding movement along the rod axis Y between the operative member and the control rod. Further, the slide contact surface 38G is formed as part of the smooth spherical surface equidistant from the tilt center P of the control rod 20, which can realize smooth and stable tilting movement.

Four recesses 38S are formed in the top surface of the operative member 38 adjacent outer peripheries thereof to be fitted to positioning pieces (not shown) projecting downward from the bottom surface side of the top cover 11, thereby maintaining a proper relative positional relationship between the depressing portions 38B of the operative member 38 and the detecting positions.

[Depression Detecting Section]

The depression detecting section B includes a dome-shaped spring plate element 45 covering the center electrode 41 and ring electrode 42 of the lower case 13, a first contact element 46 provided above the spring plate element 45, and a second contact element 47 fitted and connected to the first contact element. Further, a return spring 48 of the compression coil type is provided between the spring bearing 13D and the spring bearing member 26 of the control rod 20.

Similarly to the tilt detecting section A, the spring plate element 45 employs a disk-shaped material made of a conductor such as a copper alloy, iron alloy or the like, and has a dome shape bulging upward at the central portion thereof. When free from a depressing force, the spring plate member 45 is in contact with the ring electrode 42 at the peripheral portion thereof and out of contact with the center electrode 41 at the central portion thereof.

When a depressing force exceeding a predetermined value is exerted on the central portion of the spring plate element 45 from above, the central portion of the spring plate element 45 is elastically deformed to contact the center electrode 41, thereby allowing the center electrode 41 to be conductive with the spring electrode 42 through the spring plate element 45. The drawings show a construction in which the single spring plate element 45 is provided. Instead, a plurality of such spring plate elements may be layered.

The lower, first contact element 46 is made of a relatively soft insulating resin material such as silicon rubber or the like, while the upper, second contact element 47 is made of a relatively rigid insulating resin material. The first contact element 46 and the second contact element 47 are fitted and connected to each other. The lower, first contact element 46 is guided by the inner wall surface of the contact portion 13C to be vertically displaceable. Since the upper, second contact element 47 has a concave surface coinciding with the shape of the contact portion 25 formed at the lower end of the control rod 20, the contact portion 25 can reliably transmit pressure to the spring plate element 45 through the first contact element 46 even when the control rod 20 is more or less tilted.

An amount of projection of the rib-like contact portion 13C from the bottom wall portion 13B of the lower case 13 is determined so that the contact portion 13C contacts the spring bearing member 26 when the control rod 20 is depressed and after the depression detecting section B reaches a detecting state by the depressing force exerted from the control rod 20.

[Rotation Detecting Section]

The rotation detecting section C includes a rotor 56 rotatable by the plurality of engaging pieces 24 formed on the control rod 20, a contact 57 formed on the lower surface of the rotor 56, and a click spring 58 formed on the lower surface of the rotor 56 as shown in FIGS. 7, 9 and 10.

The rotor 56 is formed by molding an insulating resin material, and includes a cylindrical portion 56A formed at the central portion thereof, a flange portion 56B formed at the lower end of the cylindrical portion 56A, and engageable portions 56C formed at the upper end of the cylindrical portion 56A for receiving the engaging pieces 24. The engageable portions 56C are formed to allow the engaging pieces 24 to be tilted with tilting of the control rod 20.

As shown FIG. 5, the cylindrical portion 56A of the rotor 56 has an outside diameter determined to be insertable in the aperture 1211 formed in the upper case 12, and an inside diameter at the lower end thereof to be slightly larger than the outside diameter of the contact portion 13C of the lower case 13. Therefore, with the combined switch in an assembled state, the outer surface of the cylindrical portion 56A of the rotor 56 is in light contact with the inner surface of the aperture 12H formed in the upper case 12, and at the same time the inner surface of the cylindrical portion 56A at the lower end thereof is in light contact with the contact portion 13C of the lower case 13. As a result, when the rotor 56 is rotated, a stable rotation is secured as guided by the inner surface of the aperture 1211 and the outer surface of the contact portion 13.

A rib is formed on the lower surface of the flange portion 56B of the rotor 56 to project downward. A distance between the lower end of the rib and the upper surface of the flange portion 56B is set to a value slight smaller than a vertical dimension of the space defined in the lower case 13. Thus, in the assembled state of this combined switch, the upper surface of the flange portion 56B of the rotor 56 is in light contact with the lower surface of the intermediate wall portion 12B of the upper case 12, which realizes a further stabilized rotation of the rotor 56.

As shown in FIG. 9, the contact 57 is formed as a ring-shaped member made of a conductor such as a copper alloy or the like. The contact 57 has main slide contact portions 57A formed in inner peripheries thereof to be in constant contact with the common electrode 51, and auxiliary slide contact portions 57B formed in outer peripheries thereof for slidably contacting the count electrodes 52 in specific circumferential positions. With such a construction, when the rotor 56 is rotated, the count electrodes 52 are conductive with the common electrode 51 while the auxiliary slide contact portions 57B formed in the outer peripheries of the contact 57 are in contact with the count electrodes 52. On the other hand, the count electrodes 52 are isolated from the common electrode 51 while the auxiliary slide contact portions 57B are separated from the count electrodes 52.

The click spring 58 is formed as a ring-shaped member made of a metal material that is flexibly and elastically deformable, and is deformed to project downward in two circumferential positions thereby forming a pair of projections 58A. When the rotor 56 is rotated, the projections 58A are engaged with and disengaged from the ridges and grooves 53 formed on the bottom wall portion 13B of the lower case 13 for providing a clicking feel, which produces a clicking feel for the operator.

[Assembling Process]

In assembling the combined switch, the tilt detecting section A is assembled to the upper case 12. After the top cover 11 is connected to the upper case 12 (or in parallel with assembling the tilt detecting section A to the upper case 12), the depression detecting section B and the rotation detecting section C are assembled to the lower case 13. Then, the lower case 13 is connected to the upper case 12. Assembly may be carried out in this order.

However, the assembling order is not limited to the above example. For instance, the depression detecting section B and the rotation detecting section C may be assembled to the lower case 13 first, then the upper case 12 may be connected to the lower case 13. Next, the tilt detecting section A may be assembled to the upper case 12, and then the top cover 11 may be connected to the upper case 12.

More particularly, the spring plate elements 35 are arranged in positions to cover the center electrodes 31 and ring electrodes 32 formed in the four positions of the upper case 12. The spring ring 37 is placed over the rubber ring 36, and then the fitting pieces 12S of the intermediate wall portion 12B are fitted to the receiving bores 36S and 37S of the rubber ring 36 and the spring ring 37. Next, the operative member 38 is placed on the rubber ring 36 and the spring ring 37. Then, the positioning pieces (not shown) formed on the lower surface of the top cover 11 are fitted to the recesses 38S formed in the operative member 38, thereby to connect the top cover 11.

In connecting the top cover 11, the top cover 11 is placed in tight contact with the upper case 12. At the same time, any of the engageable connecting portions 14A of the connecting pieces 14 formed in the top cover 11 is allowed to be elastically fitted to any of the plurality of engaging pieces 12T formed in the side wall portion 12A of the upper case 12, whereby the connecting process is completed.

In connecting the lower case 13 to the upper case 12, the spring plate element 45 is placed to cover the center electrode 41 and the ring electrode 42 of the lower case 13 first, and then the first contact element 46 and the second contact element 47 fitted and connected to each other are placed on the spring plate element 45. Next, the return spring 48 is placed in the spring bearing 13D on which the control rod 20 and the rotor 56 are placed in the mentioned order, thereby connecting the lower case 13 to the upper case 12.

Also, when the lower case 13 is connected to the upper case 12, the positioning process is executed by inserting the control rod 20 supported by the lower case 13 into the bore portion 38A of the operative member 38 supported by the upper case 12, and then inserting the cylindrical portion 56A of the rotor 56 into the aperture H of the upper case 12. Consequently, the lower case 13 and the upper case 12 are in tight contact with each other along the axis Y, thereby allowing any of the engageable connecting portions 15A of the connecting pieces 15 formed in the lower case 13 to be elastically fitted to any corresponding one of the plurality of engaging pieces 12T formed in the side wall portion 12A of the upper case 12 to complete the connecting process. As a result, the combine switch is completed. It should be noted that, in this connecting process, the four tilt detecting leads 33 and the single common lead 24 provided in the upper case 12 are inserted into the apertures of the lead holders 13H, thereby realizing proper postures of the tilt detecting leads 33 and the common lead 34.

When the combined switch is assembled, the return spring 48 urges the control rod 20 upward by an urging force, and thus the operative member 38 contacts the upper end of the large diameter portion 23 of the control rod 20, thereby maintaining a contact state where the slide contact surface 38G of the operative member 38 contacts the guide surface 11G of the top cover 11. Also, the control rod 20 is maintained in the neutral position N by the urging force directly exerted on the control rod 20 from the return spring 48 and the force exerted on the operative member 38 from the shock absorbing elements 36A of the rubber ring 36 (provided that no external force is exerted).

With no external force being exerted, the spring plate elements 35 provided in the four detecting positions of the tilt detecting section A are maintained in positions spaced from the center electrodes 31, while the spring plate element 45 of the depression detecting section B is maintained in a position spaced from the center electrode 41. Further, the main slide contact portions 57A formed in the inner peripheries of the contact 57 provided in the rotor 56 contact the common circuit 51 of the rotation detecting section C, while the auxiliary slide contact portions 57B formed in the outer peripheries of the contact 57 are in contact with or out of contact with the count electrodes 52.

[Detecting Modes]

As shown in FIG. 6, when the control rod 20 is tilted to any direction with reference to the neutral position N, the operative member 38 is tilted with this tilting movement. A depressing force is exerted from any one of the depressing portions 38B on the spring plate element 35 positioned in the corresponding direction through the corresponding shock absorbing element 36, thereby elastically deforming the selected spring plate element 35 to make the associated center electrode 31 conductive with the associated the ring electrode 32. Therefore, if a voltage is applied to either the four tilt detecting leads 33 or the single common lead 34, it is possible to fetch the tilting operation as a variation of a voltage signal from a corresponding one of the tilt detecting leads 33.

When the control rod 20 is tilted, the slide contact surface 38G of the operative member 38 supported by the control rod 20 moves along the guide surface 11G formed on the bottom surface side of the top cover 11, whereby the control rod 20 is tilted centering on the tilt center P. Then, in response to the tilting operation, the spring plate element 35 corresponding to the tilting direction is elastically deformed to produce a clicking feel, which allows the operator to recognize that the state in which the tilting operation has reached a detectable state.

In time of a tilting operation, since the depressing force from a depressing portion 38B of the operative member 38 is exerted on a spring plate element 35 through a shock absorbing element 36A, the shock absorbing element 36A is compressively deformed, thereby avoiding a disadvantage of damaging the spring plate element 35 by an excessive force even when a strong depressing force is applied. When the tilting force applied to the control rod 20 is relieved, the control rod 20 is returned to the neutral position N by the urging force from the spring ring 37 and the return spring 48.

When the control rod 20 is depressed, the control rod 20 moves along the rod axis Y as shown in FIG. 7. In response to this movement, a depressing operational force is exerted on the spring plate element 45 through the first contact element 46 and the second contact element 47, thereby allowing the spring plate element 45 to be elastically deformed to make the center electrode 41 conductive with the ring electrode 42. Therefore, if voltage is applied to either one of the depression detecting lead 43 and the ring lead 44, it is possible to fetch the depressing operation as a voltage signal of the depression detecting lead 43.

When the control rod 20 is depressed, the spring plate element 45 is elastically deformed to produce a clicking feel, which allows the operator to recognize that the depressing operation has reached a detectable state. Also, when the control rod 20 is depressed, the spring bearing member 26 of the control rod 20 contacts the rib-like contact portion 13C immediately after the center electrode 41 placed in the conductive state with the ring electrode 42 by the elastically deformed spring plate element 45. Further, since the first contact element 46 is flexibly and elastically deformed, it is possible to avoid a disadvantage of damaging the center electrode 41, the ring electrode 42, or the spring plate element 45 by an excessive operational force even when the control rod 20 is depressed by a strong force.

Although it is ideal that the control rod 20 is maintained in the neutral position N when the control rod 20 is depressed, it is also possible to depress the control rod 20 while being more or less tilted. Particularly, if the control rod 20 is depressed when tilted by a large amount, the spring bearing member 26 formed at the lower end of the control rod 20 contacts the contact portion 13C at the part thereof projecting most downward with the tilting operation, thereby exerting a force to return the control rod 20 to the neutral position N. As a result, the depressing operation is realized with the control rod 20 being moved close to the neutral position N.

Further, as the control rod 20 is rotated about the rod axis Y and the rotor 56 is thereby rotated, the count electrodes 52 and the common electrode 51 are brought to be conductive with each other when the auxiliary slide contact portions 57A provided at the outer peripheries of the contact 57 contact the count electrodes 52, while the count electrodes 52 and the common electrode 51 are brought to be insulated from each other when the auxiliary slide contact portions 57A are moved away from the count electrodes 52. Therefore, applying voltage to either the common electrode 51 or the count electrode 52 makes the voltage of a count lead 55 vary in a reverse direction with the rotation of the control rod 20. Then, variations of voltage signals are counted (calculated) by a circuit board external of the combined switch, thereby grasping an amount of rotation of the control rod 20 with reference to the initial rotational position (thus serving as a rotary encoder of the incremental type).

Further, when the control rod 20 is rotated, the projections 58A of the click spring 58 are repeatedly engaged with and disengaged from the ridges and grooves, and thus the clicking feel based on this engagement and disengagement allows the operator to recognize the rotating operation of the control rod 20.

[Characteristic Functions of the Present Invention]

According to the present invention, it is also possible to form the four center electrodes 31 and the ring electrodes 32 constituting the tilt detecting section A in the intermediate wall portion 12B integrally formed with the upper case 12, place the spring plate elements 35 in the positions to cover these electrodes, lay the spring ring 37 on the rubber ring 36, place the operative member 38 on this unit, and then connect the top cover 11 thereto. Allowing an assembly in the mentioned order makes it possible to assemble the tilt detecting section A without considering an order of assembling the depression detecting section B and the rotation detecting section C.

It is also possible to form the center electrode 41 and the ring electrode 42 of the depression detecting section B on the lower wall portion 13B integrally formed with the lower case 13, place the spring plate element 45 in the position to cover these electrodes, further provide the first contact element 46, the second contact element 47 and the compression coil spring 48, place the rotor 56 of the rotation detecting section C, and then connect the upper case 12 thereto. Allowing an assembly in the mentioned order makes it possible to assemble the depression detecting section B and the rotation detecting section C without considering an order of assembling the tilt detecting section A.

Particularly, according to the combined switch of the present invention, the tilt detecting section A is arranged on the upper surface of the intermediate wall portion 12 integrally formed with the upper case 12, and the depression detecting section B and rotation detecting section C are arranged on the upper surface of the bottom wall portion 13B of the lower case 13. This makes it possible to assemble the unit rationally taking advantage of the acting direction of gravity, and to connect the upper case 12 to the lower case 13 without difficulty.

Since the upper case 12 includes the four tilt detecting leads 33 and the common lead 34 conductive with the tilt detecting section A, it is possible to confirm the conductive state of the tilt detecting section A during the assembling process, thereby allowing the operator to determine during the assembling process whether or not the tilt detecting section A is properly operable. Similarly, the lower case 13 includes the depression detecting lead 43 and the ring lead 44 conductive with the depression detecting section B as well as the common lead 54 and the count lead 55 conductive with the rotation detecting section C, thereby allowing the operator to determine during the assembling process whether or not the depression detecting section B and the rotation detecting section C are properly operable.

Also, according to the combined switch of the present invention, the operative member 38 for detecting the tilting movement of the control rod 20 is supported to be freely rotatable and slidable in the direction of the rod axis Y of the control rod 20, and the depression detecting section B for detecting the depression of the control rod 20 is provided in the bottom wall portion 13B of the lower case 13 to which the depressing force is transmitted directly from the control rod 20. With this construction, the rotor 56 for detecting the rotation of the control rod 20 is rotated by the rotational force of the control rod 20, while allowing the tilting movement of the control rod 20.

Therefore, when the control rod 20 is tilted, only the operative member 38 is tilted together with the control rod 20 without transmitting the tilting movement to the rotor 56 or the depression detecting section B, whereby the spring plate element 35 relating to the tilting movement is elastically deformed by the depressing force to allow the tilt detecting section A to detect the tilting movement properly.

Also, when the control rod 20 is depressed, only the spring plate element 45 is elastically deformed by the depressing force without transmitting the depressing force to the operative member 38 and the rotor 56, thereby to allow the depression detecting section B to detect the depressing operation properly.

Further, when the control rod 20 is rotated, the rotational force is transmitted only to the rotor 56 without being transmitted to the operative member 38 or the depression detecting section B to rotate the rotor and vary the contact position of the contact 57, thereby allowing the rotation detecting section C to detect the rotational operation properly.

The above-noted modes enable these three types of operation methods to be used, thereby rationally realizing the combined switch for detecting plural types of operation properly while avoiding the possibilities of causing false detection and decreasing durability without involving unnecessary operations.

According to the present invention, the return spring 48 is disposed in the position surrounding the depression detecting section B. Thus, when the control rod 20 is tilted, a biased load is applied to the return spring 48 to cause an urging force to act in the direction to return the control rod 20 to the neutral position N. Further, when the control rod 20 is depressed with a tilting operation being executed, the control rod 20 is guided by the bore portion 38A of the operative member 28 to be displaced along the rod axis Y. The spring bearing member 26 provided in the lower end of the control rod 20 contacts the contact portion 13C in the position closest to the contact portion, thereby to allow a restoring force to act on the control rod 20 in proportion to the depressing operational force.

Thus, when the control rod 20 is depressed while being tilted, the control rod 20 is returned to the neutral position N by the urging force of the return spring 48 and the force exerted from the contact portion 13C. In this condition, the depressing force is exerted on the central position of the spring plate element 35 of the depression detecting section B to realize an operation for proper detection. The operator can recognize such exertion of the return force as a feel, which allows the operator of the switch to be aware of returning the control rod 20 to the neutral position N.

Even in the condition in which a great force is exerted in the depressing direction on the control rod in the neutral position such as the case where a knob or the like is driven into the distal end of the control rod to be rigidly connected thereto, the spring bearing member 26 provided at the lower end of the control rod 20 contacts the contact portion 13C to receive that great force, thereby avoiding a disadvantage that the depression detecting section B is damaged by an excessive operational force.

Also, according to the present invention, when the control rod 20 is tilted, the operative member 38 is tilted in unison with the control rod 20, a pressure from the depressing portions 38B is exerted on the spring plate elements 35 through the shock absorbing elements 36A to elastically deform the spring plate elements 35, as a result of which the center electrodes 31 become conductive with the ring electrodes 32. When a great force is applied to the control rod 20 in the tilting direction, a corresponding shock absorbing element 36A is deformed to act on the associated spring plate element 35 over a large area, thereby avoiding a disadvantage that the spring plate element 35 is damaged by an excessive tilting force.

The shock absorbing elements 36A project from the upper and lower surfaces of the rubber ring 36. The rubber ring 36 is in tight contact with the spring ring 37. The shock absorbing elements 36A formed on the rubber ring 36 are inserted into the bore portions 37A formed in the spring ring 37. Therefore, the shock absorbing elements 36A are in a fixed posture. Further, since urging forces exerted from the four shock absorbing elements 36A act on the four depressing portions 38B of the operative member 38, the control rod 20 is maintained in the neutral position N by the force exerted from the operative member 38 to the control rod 20. Particularly, the receiving bores 36S and 37S formed in the rubber ring 36 and spring ring 37 are engaged with the fitting pieces 12S projecting from the intermediate wall portion 12B, whereby the positional relationship between the rubber ring 36, spring ring 37 and upper case 12 is properly maintained to allow the shock absorbing elements 36A formed on the rubber ring 36 to be properly positioned relative to the center electrodes 31 and ring electrodes 32.

Further, the operative member 38 is fitted on the control rod 20, thereby allowing relative movement along the rod axis Y between the control rod 20 and operative member 38 and relative rotation about the rod axis Y between the control rod 20 and operative member 38. Therefore, a depressing operation of the control rod 20 is detected by the depression detecting section B and a rotational operation of the control rod 20 is detected by the rotation detecting section C without influencing the tilt detecting section A.

[Other Embodiments]

The present invention may be modified as indicated below apart from the embodiment described above.

(a) Projections acting as the engaging portions may be formed on the side wall portion 12A of the upper case 12 while recesses may be formed in the connecting pieces 14 and 15. Alternatively, a combination of a plurality of recesses and a plurality of projections may be provided for the side wall portion 12A.

(b) In forming the tilt detecting section A and depression detecting section B, electrodes and conductive rubber may be used to allow the conductive rubber to be elastically deformed by receiving a depressing force and to contact the electrodes thereby establishing a conductive state. Alternatively, a small limit switch may be used as the depression detecting section.

(c) The rotation detecting section C may be formed of a rotary encoder of the absolute type.

(d) It is possible to arrange the rotor 56 inside the upper case 12, arrange the operative member 38 inside the lower case 13, or arrange the depression detecting section C to be spaced from the lower end of the control rod 20. Thus, the arrangements of the tilt detecting section A, depression detecting section B and rotation detecting section C are not limited to the arrangements in the embodiment as long as the tilt detecting section A, depression detecting section B and rotation detecting section C can function to perform the detections independently.

(e) A material having high wear resistance, for example, may be attached to the bottom wall portion using an adhesive technique or the like to act as the contact portion, instead of the construction in which the contact portion is integrally formed with the casing. Alternatively, the contact portion may be formed of a plurality of members projecting upward from the bottom wall portion, instead of the annual contact portion.

(f) In order to enhance the shape-retaining property of the rubber ring 36 and maintain the proper positions of the shock absorbing elements 36A, the rubber ring 36 may be formed to have the spring plate elements 35 inserted thereinto. Thus, any elements having different elastic deformation acceptable amounts may be joined together to enhance the shape-retaining property of the rubber ring 36.

DESCRIPTION OF REFERENCE SIGNS

Figure 1:
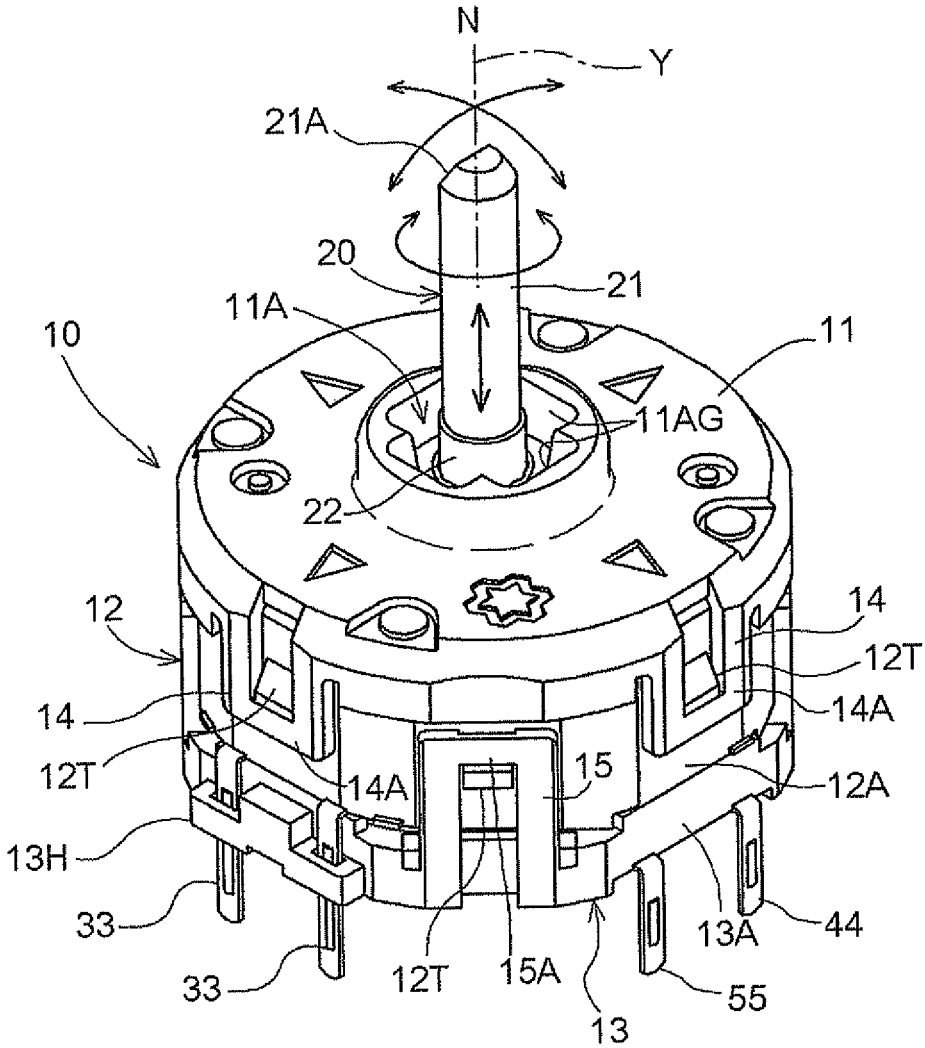
FIG. 1 is a perspective view of a combined switch.
Figure 2:
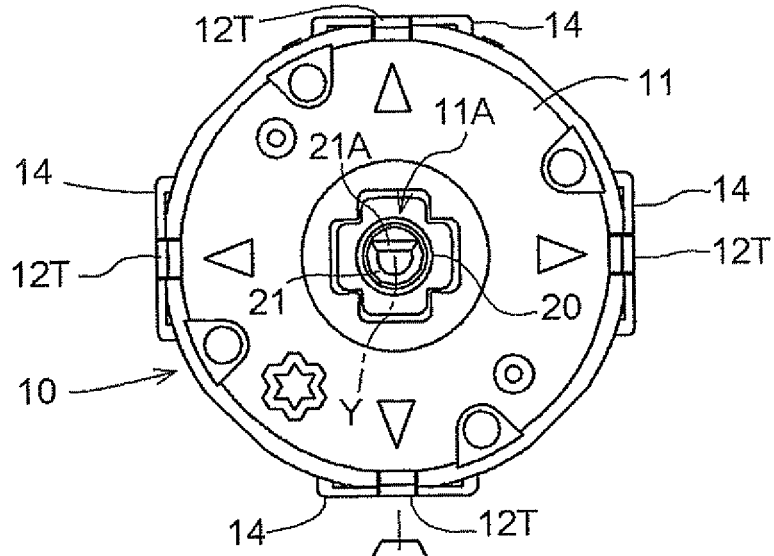
FIG. 2 includes a plan view, a side view and a bottom view of the combined switch.
Figure 2:
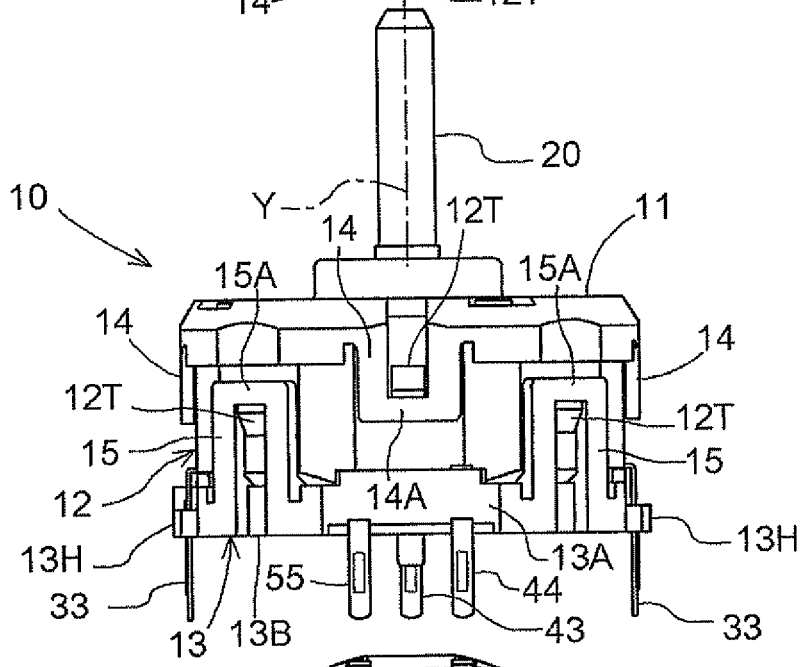
Figure 2:
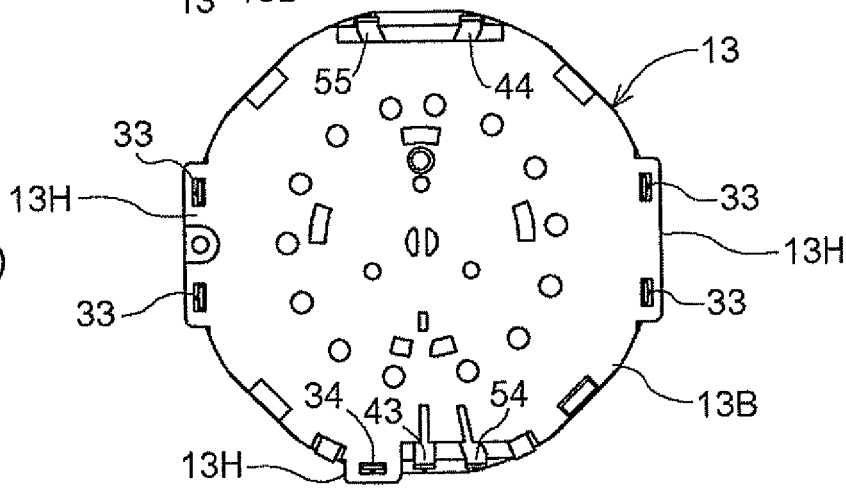
Figure 3:
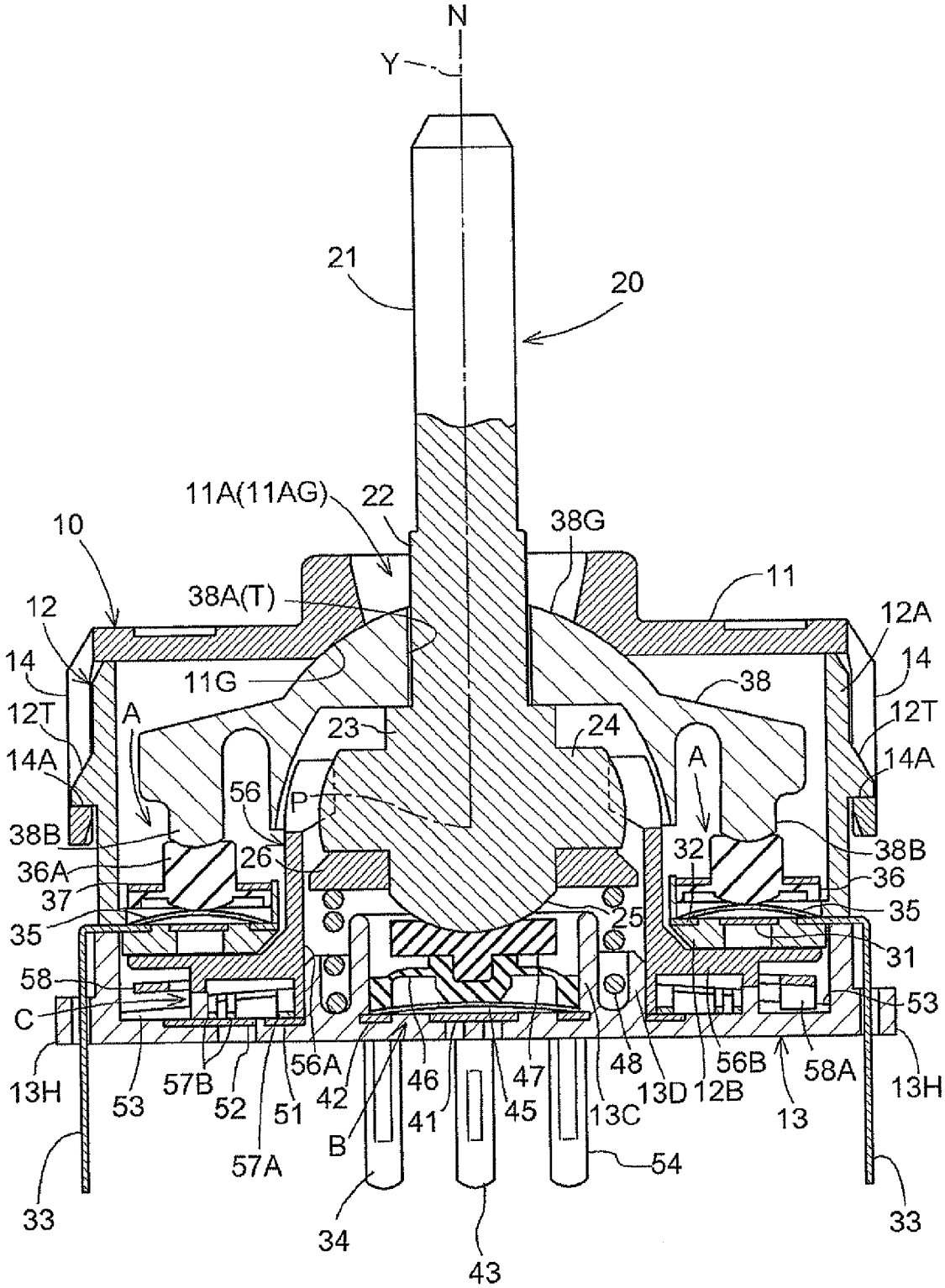
FIG. 3 is a view in vertical section of the combined switch.
Figure 4:
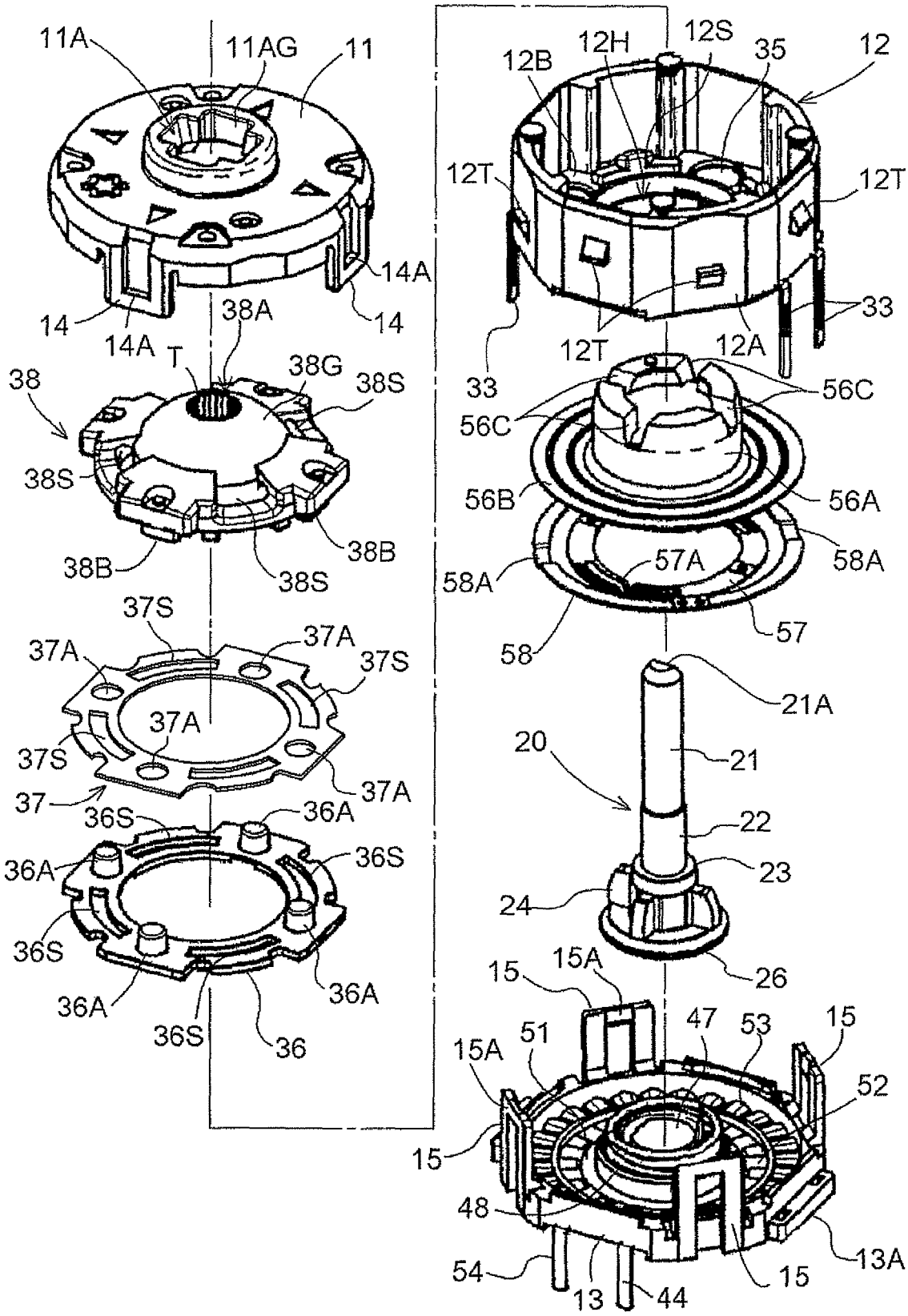
FIG. 4 is an exploded perspective view of the combined switch.
Figure 5:
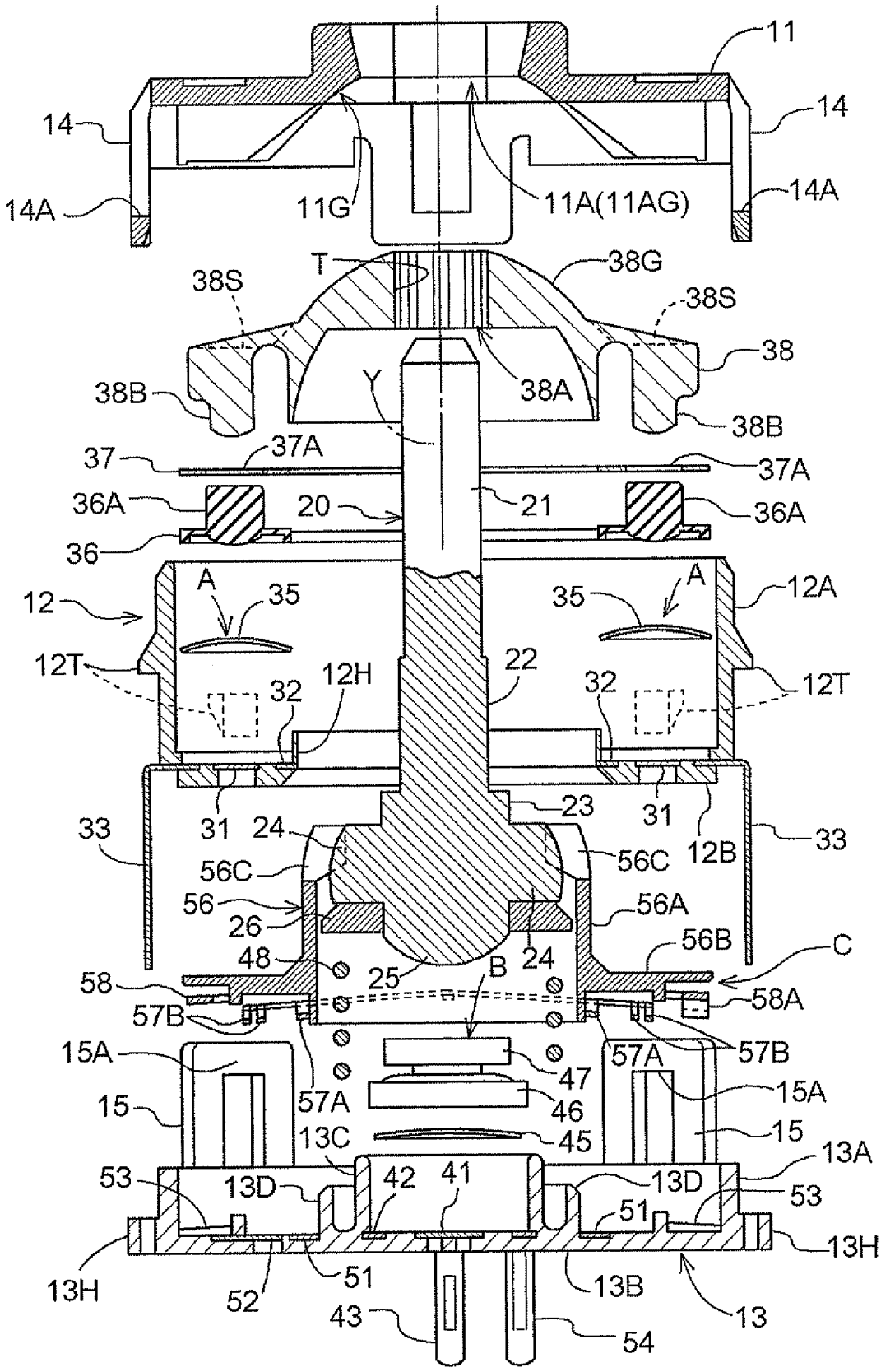
FIG. 5 is a sectional view of the combined switch in an exploded state.
Figure 6:
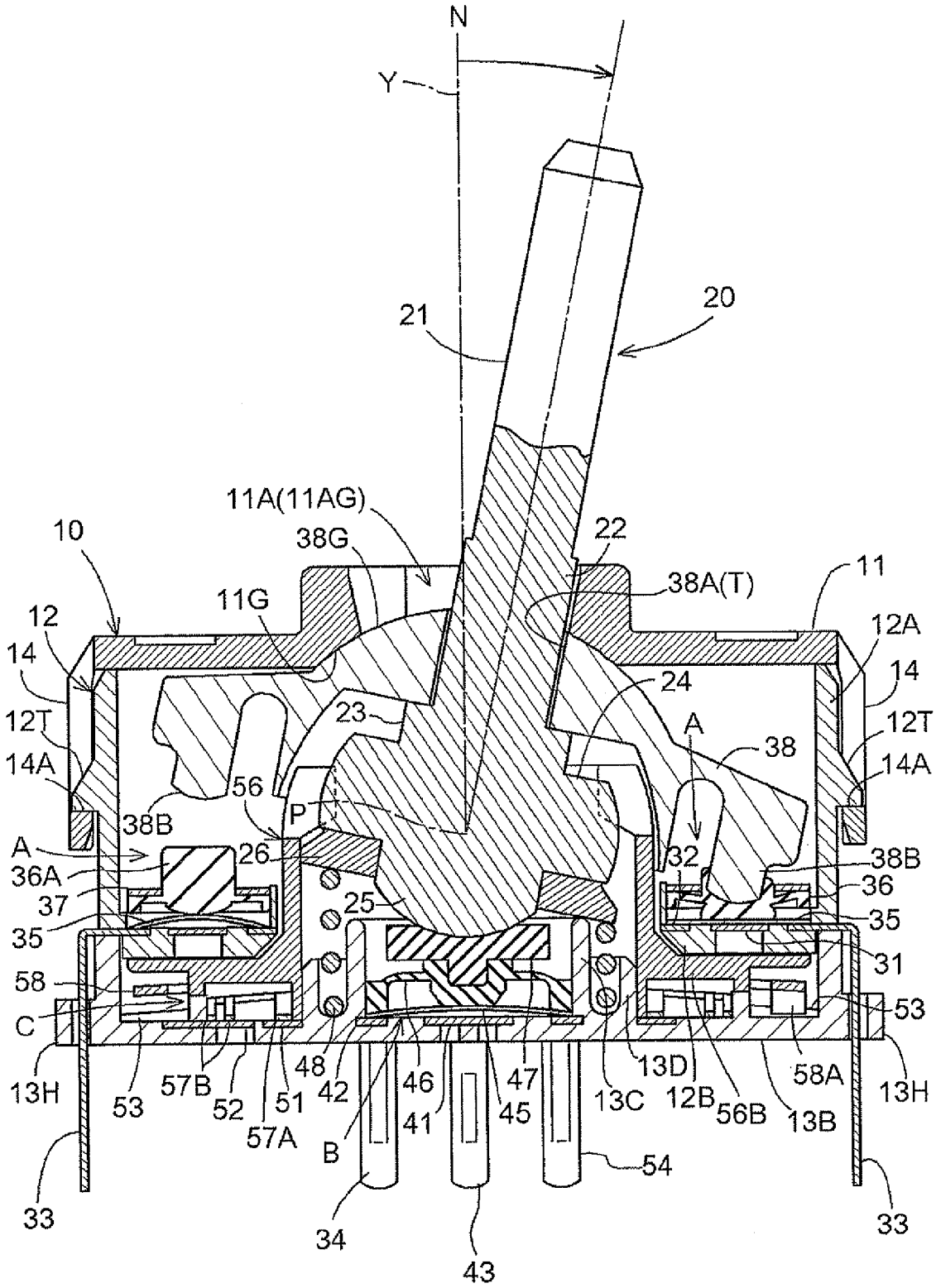
FIG. 6 is a side view in vertical section of the combined switch in a state of a tilting operation.
Figure 7:
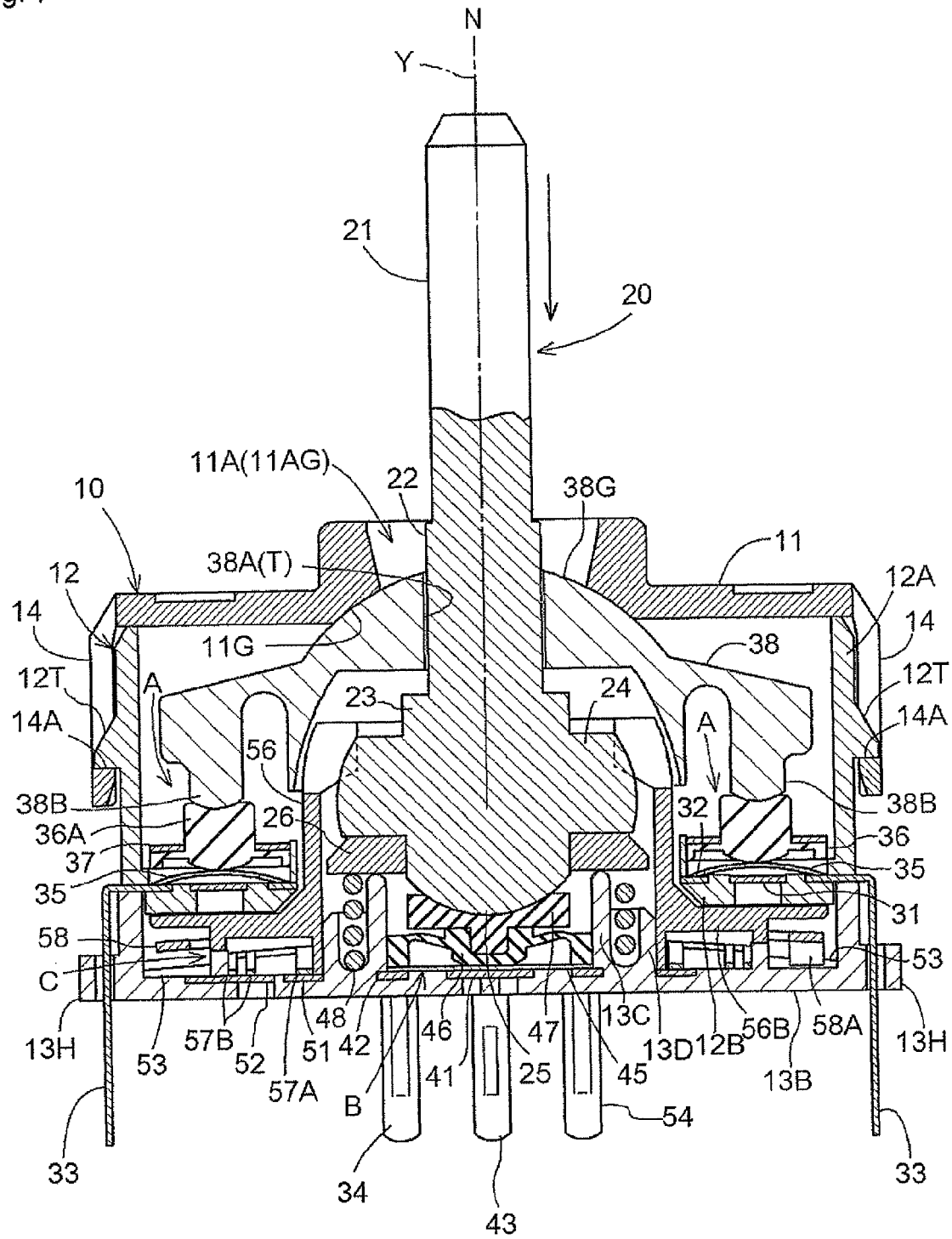
FIG. 7 is a side view in vertical section of the combined switch in a state of a depressing operation.
Figure 8:
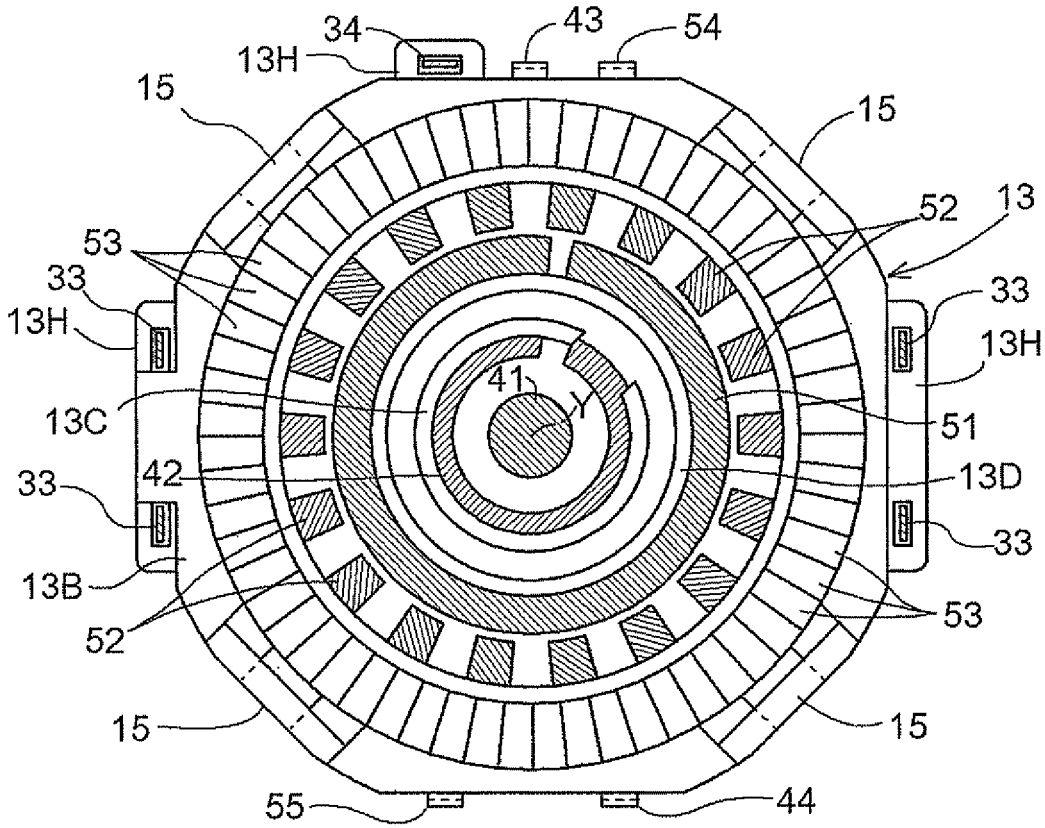
FIG. 8 is a view showing an arrangement of electrodes provided in a bottom wall portion of a lower case.
Figure 9:
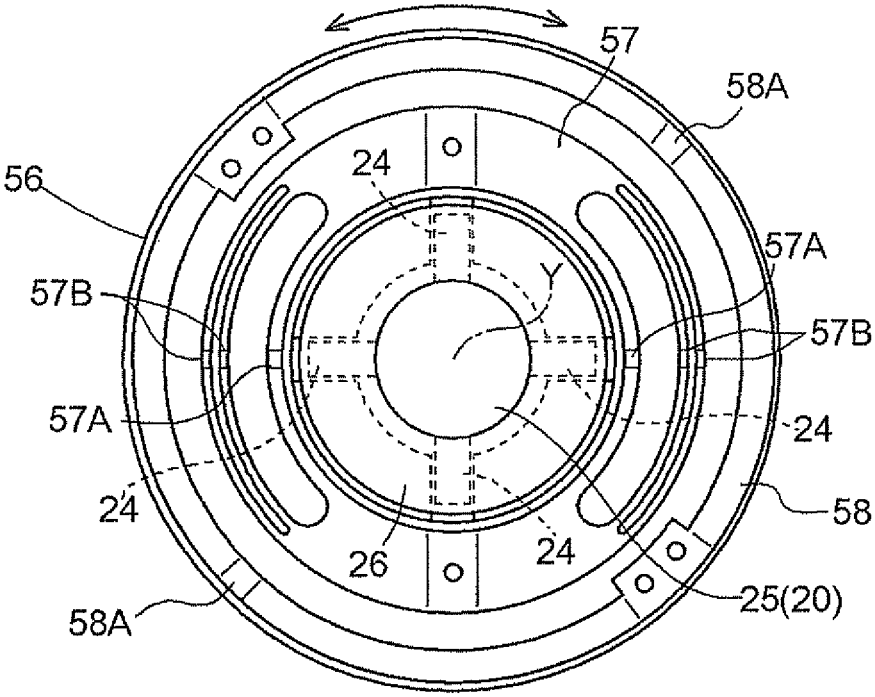
FIG. 9 is a view showing a contact provided on a rotor.
Figure 10:
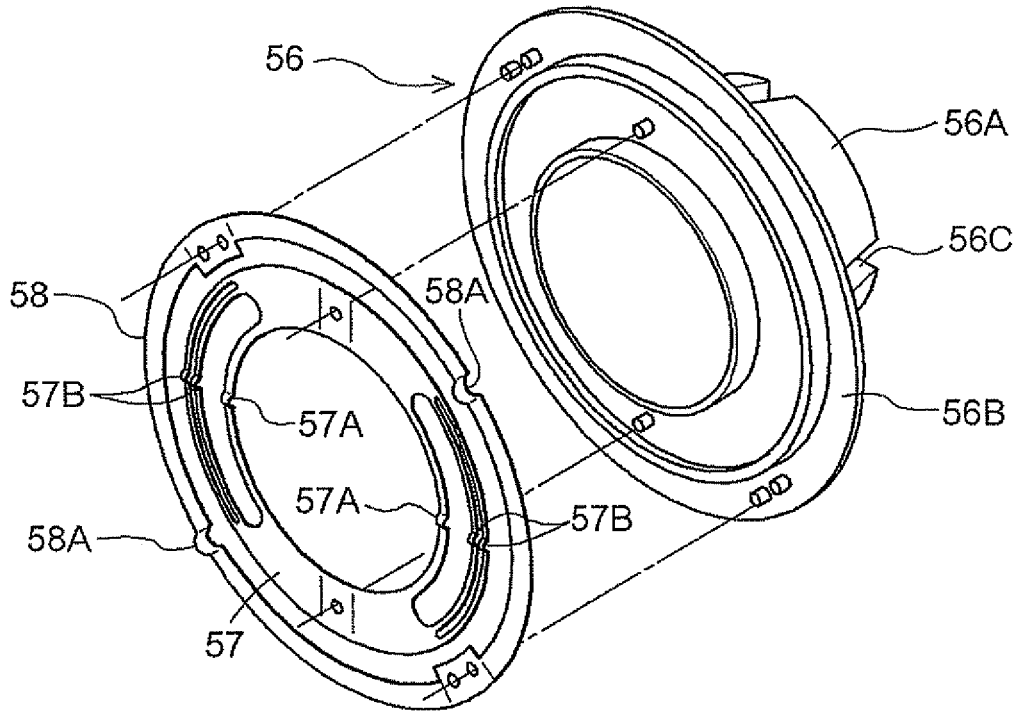
FIG. 10 is an exploded perspective view of the rotor and the contact.
Figure 11:
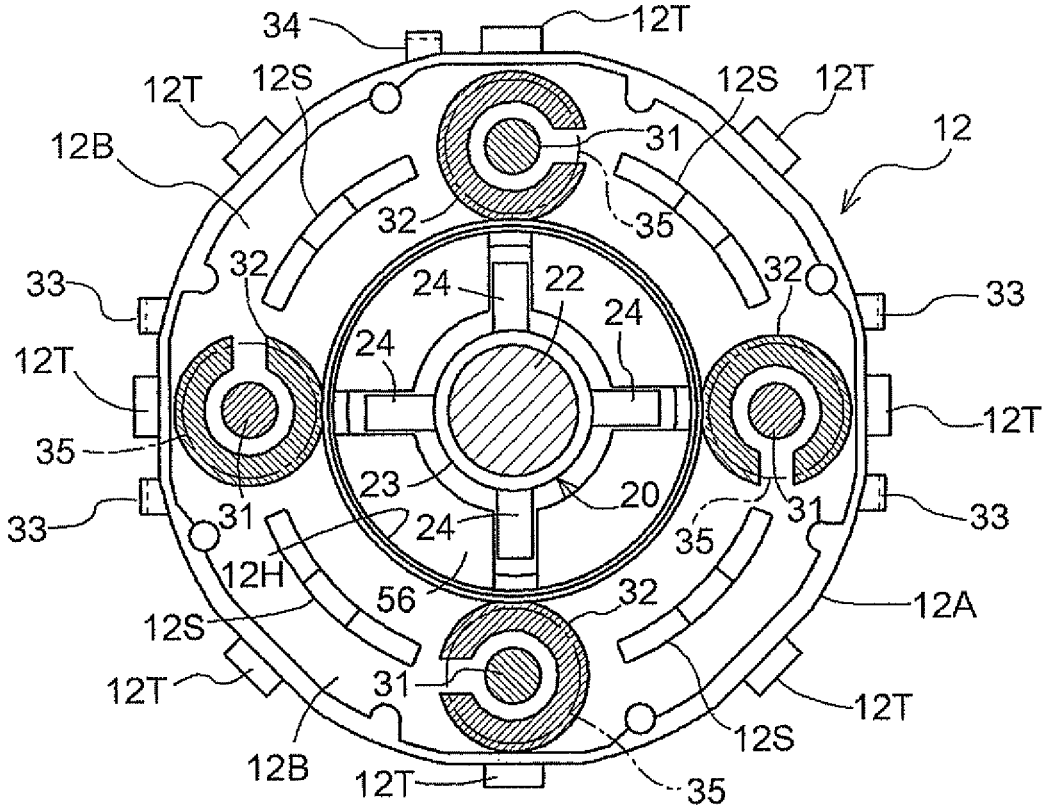
FIG. 11 is a view showing an arrangement of electrodes provided on an intermediate wall portion of an upper case.

10 casing
11 top cover
11A through bore
11G guide surface
12 upper case
12A side wall portion
12B intermediate wall portion
12T engaging portions (engaging pieces)
13 lower case
13B bottom wall portion
13C contact portion
13D spring bearing
14 connecting pieces
14A connecting portions (engageable portions)
15 connecting pieces
15A connecting portions (engageable portions)
20 control rod
24 engaging pieces
26 spring bearing member
31, 32 electrodes (center electrode, ring electrode)
35 spring plate elements
36 ring member (rubber ring)
36A shock absorbing elements
37 spring ring
38 operative member
38A bore portion
38B depressing portions
41, 42 electrodes (center electrode, ring electrode)
45 spring plate element
48 return spring
52 electrodes (count electrodes)
56 rotor
56A cylindrical portion
56C engaging portions
57 contact
A tilt detecting section
B depression detecting section
C rotation detecting section
N neutral position
T grooves
Y rod axis

The invention claimed is:

1. A switch comprising a tilt detecting section for electrically detecting a tilting operation of a control rod supported by a casing, the switch further comprising:

a depression detecting section for electrically detecting a depressing operation of the control rod in a direction along a rod axis of the control rod, and a rotation detecting section for electrically detecting a rotational operation of the control rod, wherein the casing has a structure having, layered and connected to each other, an upper case provided to an upper side and a lower case provided to a bottom side, wherein the casing accommodates therein an operative member tiltable in association with a tilting movement of the control rod and a rotor rotatable in association with a rotational movement of the control rod, wherein said rotor forms a cylindrical central portion and a flange portion projecting from the lower end of the cylindrical central portion, wherein the upper case includes an intermediate wall portion perpendicular to the rod axis of the control rod resting in a neutral position, the intermediate wall portion being formed in a position overlapped with an upper side of the flange portion of the rotor, the intermediate wall portion being provided with an aperture through which the cylindrical central portion is inserted, the tilt detecting section being provided adjacent an upper surface of the intermediate wall portion and positioned lower than an upper end of the cylindrical central portion, in a position surrounding the cylindrical central portion, the tilt detecting section being configured to detect a tilting movement of the control rod based on a tilting movement of the operative member, and wherein the lower case includes a bottom wall portion parallel to the intermediate wall portion, the depression detecting section being provided in a central position of an upper surface side of the bottom wall portion and below the cylindrical central portion of the rotor, the tilt detecting section being provided in a position surrounding the depression detecting section, the rotation detecting section being provided along the rod axis in the neutral position.

2. A switch as claimed in claim 1, wherein the upper case has a structure including a side wall portion surrounding outer peripheries of the intermediate wall portion, the side wall portion having an upper end rigidly connected to a top cover.

3. A switch as claimed in claim 2, wherein the side wall portion includes a plurality of engaging portions formed to project from or to be recessed in an outer surface thereof while the top cover and the lower case include connecting pieces projecting therefrom and having connecting portions, respectively, to be engageable with and connected to the engaging portions, and wherein the top cover is placed over the upper case to engage and connect the engaging portions of the upper case with/to the connecting pieces of the top cover, while the lower case is placed under the upper case to engage and connect the engaging portions of the upper case with/to the connecting portions of the lower case.

4. A switch comprising a tilt detecting section for electrically detecting a tilting operation of a control rod supported by a casing, the switch further comprising:

a depression detecting section for electrically detecting a depressing operation of the control rod in a direction along a rod axis of the control rod, and a rotation detecting section for electrically detecting a rotational operation of the control rod, and an operative member fitted on and supported by the control rod to be rotatable about the rod axis relative to the control rod and relatively movable along the rod axis, and to be tilted together with the control rod tilted, the tilt detecting section executing a detecting operation with tilting movement of the operative member, wherein the depression detecting section is provided in a bottom wall portion of the casing adjacent an inner surface thereof to execute a detecting operation by pressure received from the control rod when the control rod is depressed, and wherein the switch further comprises a rotor rotatable in unison with the control rod rotated and maintaining a predetermined position relative to the casing when the control rod is depressed or tilted, the rotation detecting section detecting a rotational operation of the rotor, and wherein engageable portions are formed in an inner peripheral surface of a cylindrical portion formed centrally of the rotor while engaging pieces are formed on the control rod to be engaged with the engageable portions, thereby to allow the control rod to be tilted and depressed while the rotational operation of the control rod is transmitted to the rotor, the engageable portions are formed as grooves extending in respective tilting directions, the engaging pieces being formed protrudingly from the control rod so as to fit into the respective grooves.

5. A switch as claimed in claim 4, wherein the casing has a top cover including a concave guide surface formed on an inner surface thereof to be equidistant from a tilt center of the control rod, and wherein an urging force produced by a return spring for urging the control rod in a direction counter to the depressing operation is exerted from the control rod on the operative member, thereby placing the operative member in pressure contact with the guide surface.

* * * * *